US006225612B1

(12) United States Patent
Enegren

(10) Patent No.: US 6,225,612 B1
(45) Date of Patent: May 1, 2001

(54) ELECTRODE STRUCTURE FOR DIELECTRIC HEATING

(75) Inventor: Terry Albert Enegren, Vancouver (CA)

(73) Assignee: Heatwave Drying Systems Ltd., Crescent Valley (CA)

( * ) Notice: Subject to any disclaimer, the term of this patent is extended or adjusted under 35 U.S.C. 154(b) by 0 days.

(21) Appl. No.: 09/612,443

(22) Filed: Jul. 7, 2000

(51) Int. Cl.[7] ..... H05B 6/54

(52) U.S. Cl. ..... 219/780; 219/773; 219/774; 34/250

(58) Field of Search ..... 219/780, 773, 219/775, 770, 777, 774; 34/250, 251, 254

(56) References Cited

U.S. PATENT DOCUMENTS 2,532,460 * 12/1950 Phillips, Jr. ..... 34/254
3,986,268 10/1976 Koppelman .
4,398,816 * 8/1983 Krishnakumar et al. ..... 219/780
5,942,146 8/1999 Blaker et al. .
6,030,490 * 2/2000 Francisco et al. ..... 219/780
6,080,978 * 6/2000 Blaker et al. ..... 219/775

OTHER PUBLICATIONS

Exerp from Main COFI Report. (No Date).

* cited by examiner

*Primary Examiner*—Philip H. Leung
(74) *Attorney, Agent, or Firm*—C. A. Rowley

(57) ABSTRACT

A dielectric heating or drying system incorporating an electrode structure, which is provided with wings that projects toward the opposite electrode along each side of a planar central portion of the electrode and function to improve electric field uniformity through the load being dried.

6 Claims, 3 Drawing Sheets

ELECTRODE STRUCTURE FOR DIELECTRIC HEATING

FIELD OF INVENTION

The present invention relates to radio frequency (RF) heating and drying systems incorporating improved electrode structures.

BACKGROUND OF THE INVENTION

Dielectric heating/drying systems are known and are currently in use or have been proposed for use in agriculture, polymer manufacture, pharmaceuticals, bulk powder, food processing, wood products, building materials, and other industries. One of the key industries using these dielectric heating/drying systems is the wood products industry and the present invention will be described particularly with respect to the wood products industry although the invention, with suitable modifications where required, may be applied in the other industries in which dielectric heating/drying is to be performed.

In dielectric drying systems (particularly those for drying wood of the type described in U.S. Pat. No. 3,986,268 issued Oct. 19, 1976 to Koppelman), it is conventional practice for the lumber to be moved into the drying chamber, at least one power electrode that will emit electromagnetic energy and a grounding electrode to complete the circuit are positioned near or in contact with the load. After the load has been positioned in the kiln, the kiln chamber is closed and the drying process is commenced by applying a negative pressure in the chamber and applying power (energy) to the load through the power and grounding electrodes. U.S. Pat. No. 5,942,146 issued Aug. 24, 1999 to Blaker et al. (the disclosure of which is incorporated herein by reference) teaches that shaping of the electrode connectors, (elements carrying the power to the load) is important and describes the minimum curvature required for improved operation.

The electrodes used in dielectric drying systems generally have a planar surface facing the load. One theoretical system to obtain optimum RF uniformity within the load requires that the power electrode have an infinitely long and infinitely wide planer surface; obviously, this is not practical.

It is Applicant's understanding that an experiment incorporating small wings or flanges at the sides of the electrodes and projecting on opposite sides of the load was previously performed and while an effect was observed the effect was of minimal practical significance in comparison to the Applicant's current invention.

BRIEF DESCRIPTION OF THE PRESENT INVENTION

It is an object of the present invention to provide an improved electrode structure to improve the electric field uniformity through the load being heated and/or dried.

Broadly the present invention relates to dielectric heating and/or drying systems comprising a chamber, a pair of opposed electrodes for applying dielectric power to a load contained between said electrodes, each said electrode having a planar electrode surface and at least one of said electrodes having a pair of wings one along each of its side, each of said wings projecting from said planar electrode surface of its electrode toward the opposed electrode of said pair of opposed electrodes, said wing of said pair of wings being laterally spaced so that said wings are positioned adjacent to an adjacent outside side surface of the load when said electrodes are in operative position to apply power to said load.

Preferably said dielectric drying comprises radio frequency drying (RFD).

Preferably said dielectric drying comprises radio frequency vacuum drying (RFVD).

Preferably each of said wings projects from its electrode planar surfaces by a distance d in the range of 26 cm to 40 cm and preferably in the range of between 29 and 36 cm.

Preferably said wings are symmetrically positioned relative to axial ends of said electrode planar surface and extend at least 80% of an axial length LE of said planar surface.

BRIEF DESCRIPTION OF THE SEVERAL VIEWS OF THE DRAWING(S)

Further features, objects and advantages will be evident from the following detailed description of the preferred embodiments of the present invention taken in conjunction with the accompanying drawings in which.

DETAILED DESCRIPTION OF THE INVENTION

The present invention may be applied to any suitable bulk RF heating/drying application between about 2 and 9 MHz; the preferred application is to RF vacuum drying (RFVD) but the invention may also be used at atmospheric pressure. Thus the term RF as used herein is intended to refer to operation at frequencies between 2 and 9 MHz.

Figure 1:
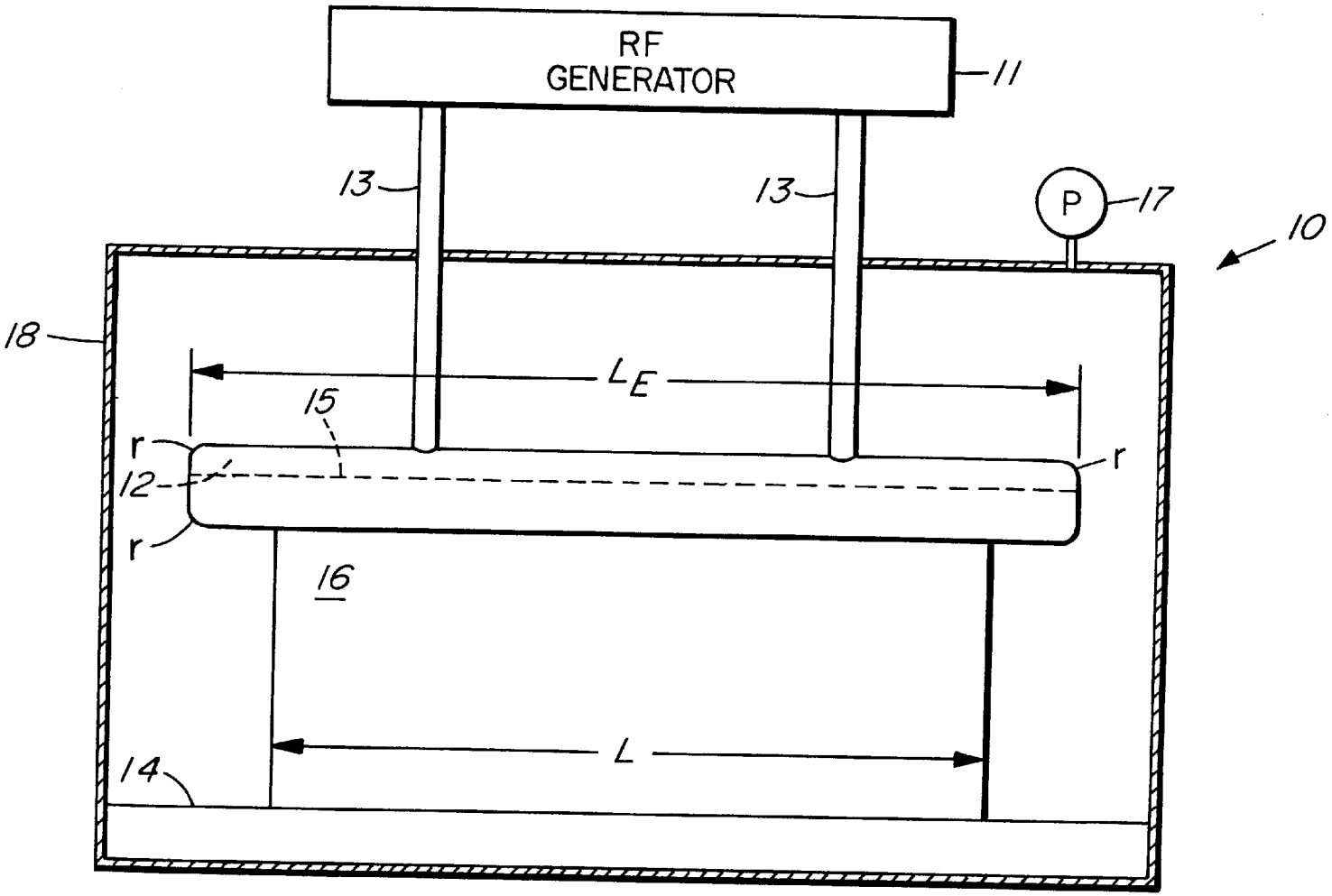
FIG. 1 is a schematic illustration of a dielectric drying kiln incorporating the features of the present invention.

As illustrated in FIG. 1, the drying kiln 10 is provided with and RF generator 11 and preferably with a vacuum system 17 for withdrawing vapors and gases from the chamber 18 of kiln 10.

The RF generator via connections 13 supplies power to a pair of opposed electrodes 12 and 14 within the chamber 18. Each electrode 12 and 14 has a planar surface; the whole surface of the electrode 14 is shown as planar while the planar surface of the electrode 12 is indicated at 15. These electrodes 12 and 14 transfer the RF energy to the load 16 as will be described in more detail hereinbelow.

Figure 2:
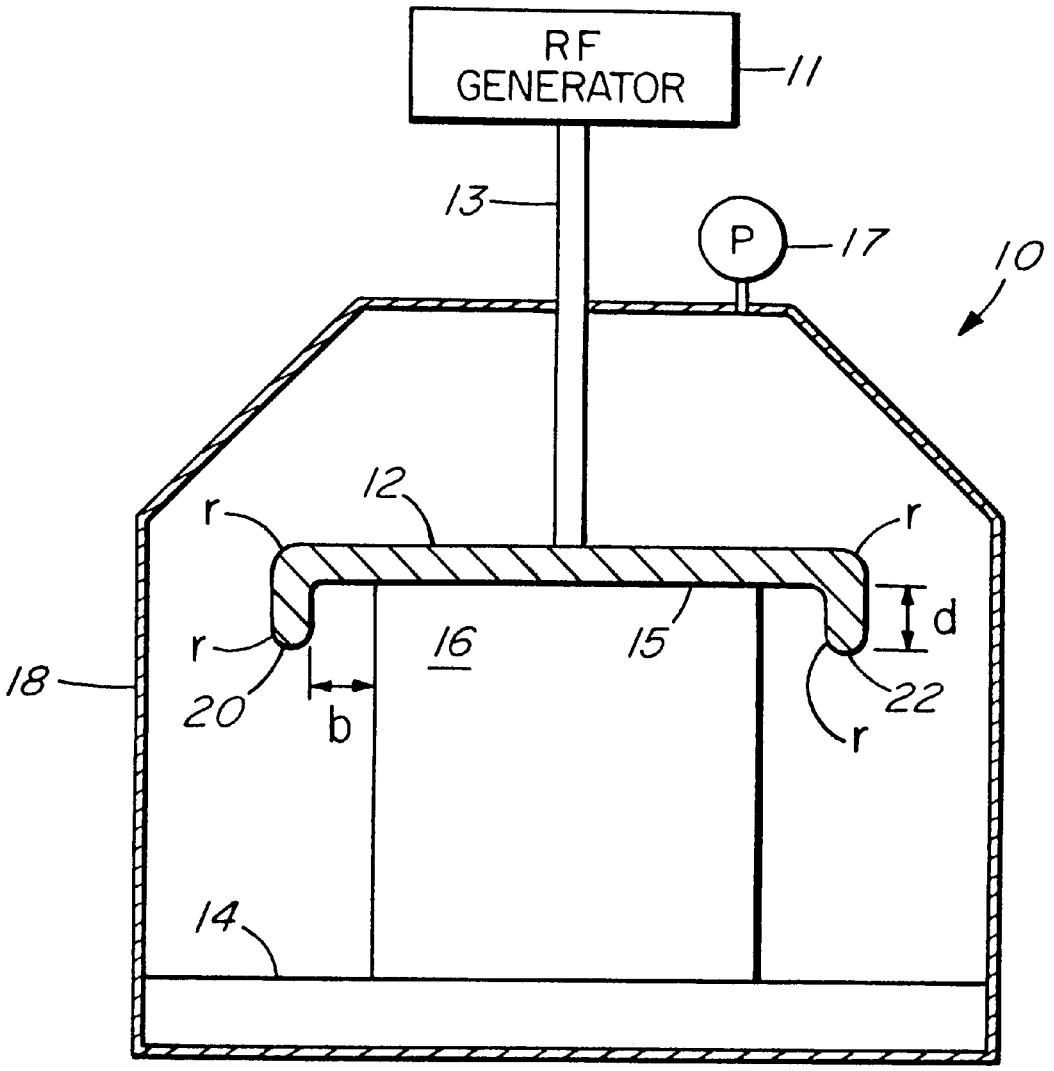
FIG. 2 is an isometric illustration of a pair of opposed electrodes configured with specifically shaped wings projecting from the planar surface of the electrodes on opposite sides of the load.

It will be apparent from FIG. 2 that all the outside edges of the electrode 12 are rounded i.e. filleted with fillets of a minimum radius r as described in the above referred to Blaker et al. the disclosure of which has been incorporated herein by reference. Generally the radius r will be at least 3 cm.

The electrode 12 is provided with a pair of lips or wings or projections 20 and 22 one positioned along each longitudinal side edge electrode 12 and projecting toward the opposing electrode 14.

Generally each wing 20 and 22 will be formed with rounded edges with minimum radius r and will project substantially perpendicular from the planar surface 15 of electrode 12 by a distance "d" measured in a direction perpendicular to the surface 15. The surfaces of the wings 20 and 22 need not be at 90° to the surface 15 and slope at slight angel off perpendicular, the important factor is the distance d.

The load should ideally be symmetrically centered under the electrode 12 so that the lips or wings 20 and 22 are reasonably uniformly spaced on opposite sides of the load 16 and preferably the distance b between the inner surface of the wing 20 (or 22) and the adjacent surface of the load 16 is at a practical minimum. Generally this spacing b will not be less than 10 cm and preferably will be greater than 15 cm. If the distance b is too small, i.e. <10 cm, areas of non-uniform heating will occur near those edges and if the distance is too great (load width too small for the kiln), excessive chamber space is wasted which price prohibitive in most practical applications.

One theoretical system to obtain optimum RF uniformity within the load requires that the power electrode have an infinitely long and infinitely wide planer surface; obviously, this is not practical. A very good uniformity can be obtained with very large b and small d but the chamber becomes prohibitively large. The present invention effectively reduces the chamber width but provides the uniformity of a very wide chamber with large b.

Each wing will extend substantially the full length L of the typical product package (load 16) length or if shorter than the typical product package length L will be at least 80% of the length L of the typical product package length and will preferably be symmetrically positioned on the electrode with its axial ends positioned the same distance from their adjacent axial ends of the electrode. For practical purposes for a given installation the wings 20 and 22 will extend at lease 80% of the length LE of the electrode 12 and preferably will extend the full length LE of the electrode 15 It is important that the distance d of the free end 24 of each wing 20 and 22 projects from the planar surface 15 of its electrode be in the range of 26 cm to 40 cm so that the standard deviation of electrical field intensity is no greater than about 2.6% and preferably will be between 29 and 36 cm to provide a standard deviation of electrical field intensity of no greater than about 2.3%.

Figure 3:
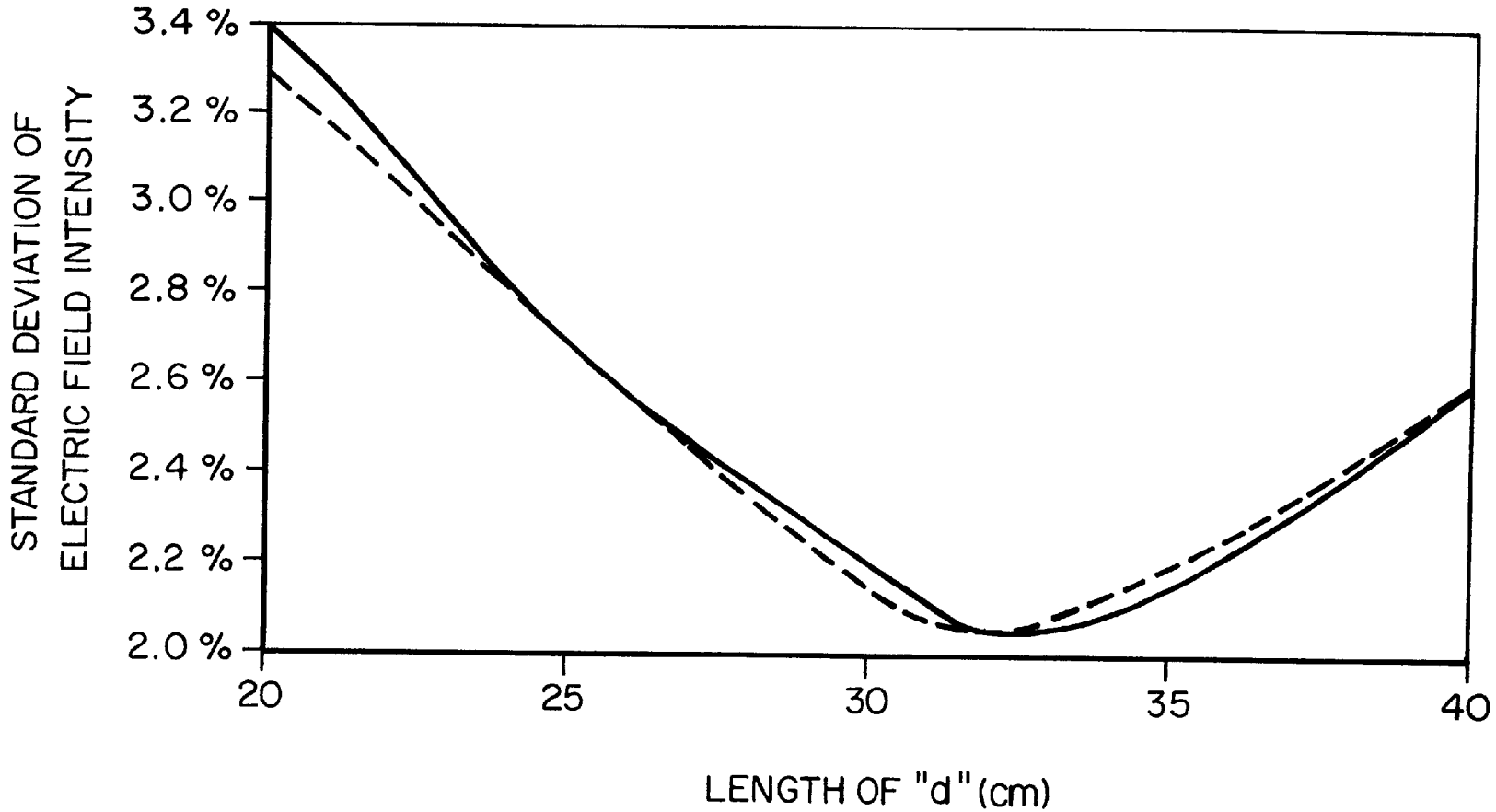
FIG. 3 is a plot of the standard deviation of electric field with change in the amount the wing or lip projects from the planar face of the electrode.

The data in FIG. 3 is based on electric field simulations completed in three dimensions and has been confirmed through the analysis of moisture uniformity in the dried load. The data upon which FIG. 3 is based was obtained by modeling the electromagnetic fields in three dimensions using different frequencies and different lengths d, and the effective maximum value or standard deviation was determined empirically based on noticeable wet spots in the dried load.

It is apparent from FIG. 3 that the standard deviation of the electric field intensity over he load is the lowest at an electrode lip length d of between approximately 31 to 33 cm indicating that the best length for d in the simulation using radio frequencies between 3.78 MHz to 6.78 MHz. The standard deviation of the electric field intensity over the entire volume of the typical drying load is directly related to "uniform heating". Uniform heating is required to achieve uniform drying. A high standard deviation of the electric field intensity will result in areas of either too low and/or too high moisture content within the drying package.

It can be seen from FIG. 3 that a standard deviation below 2.3% is attained with lengths d between 29 and 36 cm hence the preferred range for d recited above. Standard deviations of less than 2.6% are achieved at length d of between 26 and 40 cm.

Having described the invention, modifications will be evident to those skilled in the art without departing from the scope of the invention as defined in the appended claims.

We claim:

1. A dielectric drying system comprising a drying chamber, a pair of opposed electrodes for applying dielectric power to a load contained between said electrodes, each said electrode having a planar electrode surface and at least one of said electrodes having a pair of wings one along each of its sides, each of said wings projecting from said planar electrode surface of its electrode toward the opposed electrode of said pair of opposed electrodes, said wings of said pair of wings being symmetrically positioned relative to axial ends of said electrode planar surface of its electrode and being laterally spaced so that said wings are positioned adjacent to an adjacent outside side surface of the load when said electrodes are in operative position to apply power to said load, each of said wings projecting from its electrode planar surfaces toward said opposed electrode by a distance d in the range of 26 cm to 40 cm.

2. A dielectric drying system as defined in claim 1 wherein said dielectric drying comprises radio frequency drying (RFD).

3. A dielectric drying system as defined in claim 1 wherein said wings extend at least 80% of an axial length LE of said planar surface.

4. A dielectric drying system as defined in claim 1 wherein said dielectric drying system further includes a vacuum pump connected to said chamber to reduce the pressure in said chamber below atmospheric and said dielectric drying comprises radio frequency vacuum drying (RFVD).

5. A dielectric drying system as defined in claim 2 wherein said wings extend at least 80% of an axial length LE of said planar surface.

6. A dielectric drying system as defined in claim 4 wherein said wings extend at least 80% of an axial length $L_E$ of said planar surface.

* * * * *